United States Patent [19]

Ikawa

[11] 4,256,994

[45] Mar. 17, 1981

[54] ACTUATING CIRCUIT FOR LIGHT MEASURING CIRCUIT IN ELECTRONIC FLASH DEVICE

[75] Inventor: Kazuo Ikawa, Tokyo, Japan

[73] Assignee: Canon Kabushiki Kaisha, Tokyo, Japan

[21] Appl. No.: 77,722

[22] Filed: Sep. 21, 1979

[30] Foreign Application Priority Data

Oct. 7, 1978 [JP] Japan ..... 53-123892
Oct. 26, 1978 [JP] Japan ..... 53-131989

[51] Int. Cl.[3] ..... H05B 41/32

[52] U.S. Cl. ..... 315/151; 315/173; 315/241 P

[58] Field of Search ..... 315/151, 159, 240, 241 P, 315/171, 173, 176; 354/33, 145

[56] References Cited

U.S. PATENT DOCUMENTS

| | | | |
|---|---|---|---|
| 3,878,433 | 4/1975 | Sato | 315/159 X |
| 3,912,968 | 10/1975 | Nakamura | 315/241 P |
| 4,082,982 | 4/1978 | Hirata | 315/151 |

*Primary Examiner*—Eugene R. LaRoche
*Attorney, Agent, or Firm*—Toren, McGeady and Stanger

[57] ABSTRACT

A computer type electronic flash device is disclosed. The flash device has an auxiliary capacitor for producing a bias voltage which is to be superimposed on the charged voltage across the main capacitor upon triggering of the flash tube, and an impedance circuit provided in the discharge path of the auxiliary capacitor to produce an actuating voltage for the light measuring circuit when the auxiliary capacitor produces the above-described bias voltage.

8 Claims, 2 Drawing Figures

ACTUATING CIRCUIT FOR LIGHT MEASURING CIRCUIT IN ELECTRONIC FLASH DEVICE

BACKGROUND OF THE INVENTION

This invention relates to electronic flash devices, and, more particularly, to an actuating circuit for a light measuring circuit of the electronic flash device.

It is well known to provide an electronic flash device of the so-called computer type in which the reflected light from an object illuminated by the flash tube is sensed and the time duration of firing of the flash tube is controlled in accordance with the sensed light quantity.

Such computer type electronic flash device, however, when put into a lighting situation where the object to be photographed is surrounded by many photographers, or in a somewhat bright room, tends to initiate an operation of the light measuring circuit before the firing circuit is actuated. This makes it impossible not only to obtain the desired amount of flash light, but also in some cases to actuate the firing circuit.

To avoid this, according to the prior art, a capacitor is provided for supplying a driving voltage to the actuation control input of the light measuring circuit when the firing of the flash tube is initiated to thereby insure that at the same time when the flash light is emitted, the light measuring circuit starts to operate.

Another major problem in the conventional electronic flash device is that, as the flash tube is successively fired with very large consumption of electrical energy of the electrical power source or battery, the resultant voltage on the battery, though not insufficient for normal operation of the other circuit portions, is no longer effective to charge the main capacitor to the critical voltage level for the firing of the flash tube.

Indeed, this problem is solved by using an auxiliary capacitor also arranged to be connected in series to the main capacitor when the trigger switch is closed, whereby the sum of the voltages across the main capacitor and auxiliary capacitor is applied across the flash tube at the time of triggering of the flash tube.

Since the above-described two major problems in the conventional computer type electronic flash device have thus been solved, the use of the individual capacitors for the solution of the respective problems at a time gives rise to an alternative drawback that the complexity of the device is increased, the desired compactness is not achieved, and high cost of manufacture results.

SUMMARY OF THE INVENTION

An object of the present invention is to provide an actuating circuit for the light measuring circuit which has overcome the above mentioned two problems in the conventional computer type electronic flash device while nevertheless maintaining the actuating circuit in simple form.

This and other objects and features of the present invention will become apparent from the following detailed description thereof.

DESCRIPTION OF THE PREFERRED EMBODIMENTS

Figure 1:
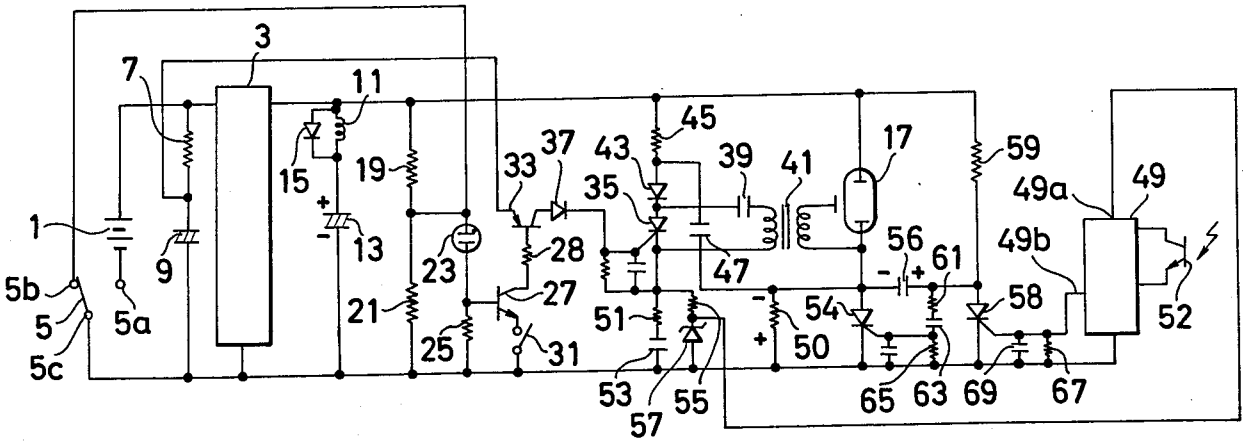
FIG. 1 is an electrical circuit diagram of one embodiment of a computer type electronic flash device according to the present invention.

FIG. 1 shows the circuitry of the computer-type electronic flash device employing one form of the present invention. 1 is an electrical power source or battery; 3 is a known voltage booster or DC—DC converter connected in parallel to the battery 1 through a change-over switch 5 for short-circuiting a neon tube 23 to be described later; 9 is a capacitor connected through a current limiting resistor 7 to the battery 1 and serving as a drive source for a transistor (not shown) provided in said DC—DC converter 3; 11 is an inductance connected in the discharge path of a main capacitor 13 to smooth the discharge characteristic of the main capacitor 13; 13 is the above-described main capacitor connected through the inductance 11 to the output terminal of the DC—DC converter 3 to store electrical energy which is to be supplied to a discharge tube 17; 15 is a diode serving as a noise killer connected in parallel to the inductance 11; 19 and 21 are resistors connected in series with each other to form a voltage dividing circuit, this series circuit being connected in parallel with the series circuit comprising the inductance 11 and the main capacitor 13. 23 is the above-mentioned neon tube for charge completion display connected to the output of the above-described voltage divider; 25 is a resistor connected in series to the neon tube 23, one terminal of this resistor 25 being connected to the base of an npn transistor 27. 31 is a trigger switch formed by, for example, a synchro switch of the camera and connected through the switching transistor 27 and a base resistor 28 to the base of a pnp transistor 33. 35 is a silicon controlled rectifier (hereinafter referred to as SCR) with its gate connected through a diode 37 to the collector of the transistor 33, this SCR 35 constituting part of a trigger circuit for the discharge tube 17 and being connected in parallel to a series circuit comprising a trigger capacitor 39 and a primary coil of a trigger transformer 41. 41 is a pulse transformer forming the above mentioned trigger transformer, a secondary coil of this transformer 41 being connected to the trigger electrode and cathode of the flash tube 17. 43 is a diode with its anode connected to the output of the DC—DC converter 3 through a resistor 45 having a high resistance value; 47 is an auxiliary capacitor for storing driving energy for a light measuring circuit 49 to be described later and electrical energy which is to be superimposed on the electrical energy on the main capacitor at the initial stage of firing of the flash tube 17, the capacitor being connected through a resistor 45 to the output of the above-described DC—DC converter 3. 50 is a resistor serving to form charge and discharge paths of the auxiliary capacitor 47 and functioning as a voltage applying element for adding the voltage of the auxiliary capacitor 47 to the voltage of the main capacitor 13 across the both poles of the flash tube 17, one terminal of this resistor 50 being connected to the cathode of the flash tube 17, and the other terminal being connected to the negative pole of the main capacitor 13. 51, 53, 55 and 57 are elements constituting an impedance circuit connected in the discharge path of the auxiliary capacitor 47, the elements 51 and 53 being a resistor and a capacitor respectively connected in series to each other, and the elements 55 and 57 being a resistor and a Zener diode respectively connected in series to each other. This series circuit comprising the resistor 55 and the Zener diode 57 is connected in parallel to the series circuit comprising the resistor 51 and the capacitor 53, and has an output terminal connected to a driving voltage input terminal 49*a* of the light measuring circuit 49. 49 is a known light measuring circuit having a light-sensitive element 52 receptive of flash light from the object being photographed with flash illumination by the tube 17 for producing an electrical signal corresponding thereto and responsive to a predetermined amount of light integrated by the photosensitive element 52 for producing a firing stop signal. 54 is a main SCR connected in the discharge path of the main capacitor 13; 56 is a known commutating capacitor connected between the anode of the main SCR 54 and the anode of a firing stop SCR 58; 59 is a resistor forming a charge path of the commutating capacitor 56; 61, 63 and 65 are a resistor, capacitor and resistor constituting a trigger circuit for the main SCR 54. 67 and 69 are a resistor and a capacitor connected between the gate and cathode of the SCR 58.

The operation of the computer type electronic flash device of the above-described construction is as follows: At first, the movable contact 5*c* of the changeover switch 5 is brought into contact with the fixed contact 5*a*, thereby the firing circuit is rendered operative. Therefore, the capacitor 9 is charged through the resistor 7 to a voltage equal to the voltage of the battery 1. Also the main capacitor 13 is charged through the inductance 11 to a predetermined voltage level at which the neon tube 23 is lit, indicating that the sufficient voltage is now available for firing the flash tube 17. At the same time, the charging of the auxiliary capacitor 47 and commutating capacitor 56 is completed. Then, when the trigger switch 31 is closed, a base current to the base of the transistor 27 flows through the resistor 19 and neon tube 23, thereby the transistor 27 is rendered conducting. At the same time, the transistor 33 is also rendered conducting. Such conduction of the transistor 33 causes a trigger voltage to be applied from the capacitor 9 to the gate of the SCR 35 through the transistor 33 and diode 37 and therefore causes conduction of the SCR 35. Then, the charge stored on the trigger capacitor 39 starts to be discharged through the SCR 35 and the primary coil of the transformer 41. Thus, a trigger pulse is generated in the secondary coil of the transformer 41 and triggers the flash tube 17.

On the other hand, such conduction of the SCR 35 also causes the charge stored on the auxiliary capacitor 47 to be discharged through the diode 43, SCR 35, impedance circuit (51, 53, 55, 57) and resistor 50. Therefore, across the resistor 50 appears a potential having a polarity shown in the figure. At this time, the potential across the main capacitor 13 takes the polarity shown in the figure. Thus, the sum of the voltages across the main capacitor 13 and the resistor, that is, the sum of the voltage across the main capacitor 13 and a voltage almost equal to the voltage across the auxiliary capacitor 47 is applied across the anode and cathode of the flash tube 17. Then, the flash tube 17 allows a minute current to be discharge therethrough and through the commutation capacitor 56, resistor 61, capacitor 63 and resistor 65. Therefore, a voltage appears across the resistor 65. As is well known in the art, the appearance of this voltage across the resistor 65 results in triggering of the SCR 54, thereby the SCR 54 is rendered conducting to establish a closed circuit which can be traced from the main capacitor 13 through the inductance 11, discharge tube 17 and the SCR 54. Thus, the charge stored on the main capacitor 13 is suddenly drawn through the inductance 11, flash tube 17 and SCR 54, and the emission of flash light from the tube 17 results with illumination of the object being photographed.

The above-described initiation of discharging of the auxiliary capacitor 47 at the time of closure of the trigger switch 31 also causes a current to flow through the above-described impedance circuit with appearance of a voltage across the Zener diode 57. Therefore, at almost the same time when the flash tube 17 starts to fire, the driving voltage is applied to the light measuring circuit 49, thereby an operation of the light-measuring circuit 49 is initiated. Then, when the amount of light reflected from the object (not shown) and integrated by the photosensitive element 51 has reached a predetermined level, the light measuring circuit 49 produces a de-actuating signal for the flash tube 17 appearing at the output terminal 49*a* thereof, and which is then applied to the SCR 58. Since the SCR 58 is conducting, the charge stored on the commutating capacitor 56 is rapidly discharged through the SCR 58 to apply a reverse bias across the SCR 54. As a result, the SCR 54 is rendered non-conducting to open the discharge path of the main capacitor 13 which can be traced therefrom through the inductance 11, flash tube 17 and SCR 54 thereto. Thus, the duration of firing of the flash tube is terminated.

Figure 2:
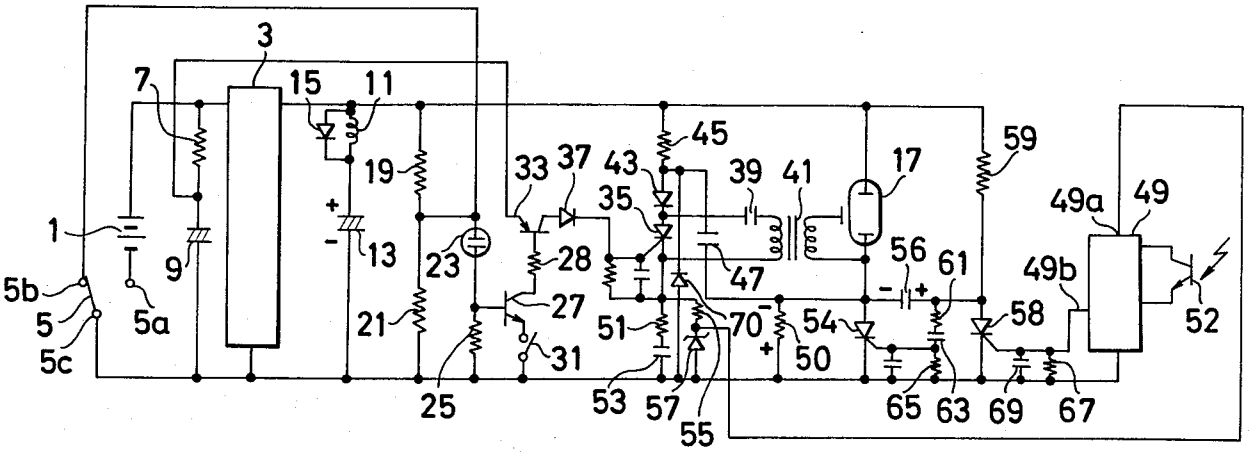
FIG. 2 is a similar diagram showing another embodiment of the present invention.

Next, explanation is given to a second embodiment of the present invention by reference to FIG. 2 which is different from the foregoing embodiment only in that an additional diode 70 is provided. For this reason, the details of the construction of the circuit of FIG. 2 are omitted, and the explanation is limited to the manner in which the circuit operates.

Referring to FIG. 2, when the movable contact 5*c* is moved to contact with the fixed contact 5*a*, the firing circuit is rendered operative. Then, in a similar manner to that described in connection with the first embodiment, the main capacitor 13, auxiliary capacitor 47, commutating capacitor 56, trigger capacitor 39 and capacitor 63 are charged to their predetermined voltage values. Then, when the trigger switch 31 is closed, the flash tube is triggered in a manner similar to that of the above-described first embodiment.

On the other hand, when the SCR 35 becomes conducting as mentioned above, the charge stored on the auxiliary capacitor 47 also is discharged through the diode 43, SCR 35, impedance circuit (51, 53, 55 and 57) and resistor 50. It should be noted here that there is no possibility for the charge on the auxiliary capacitor 47 to be discharge through the diode 70 which is adapted to protect the main SCR.

Such discharge of the auxiliary capacitor 47 causes appearance of a voltage of polarity illustrated in the figure and almost equal to the voltage across the auxiliary capacitor 47 across the resistor 50 simultaneously. Since at this time the main capacitor 13 is charged to the voltage of polarity shown in the figure, when the above-described voltage is produced across the resistor 50, the sum of the voltage across the main capacitor 13 and the voltage across the resistor 50 or the voltage almost equal to the voltage across the auxiliary capacitor 47 appears across the anode and cathode of the flash tube 17. And, since the flash tube 17 allows a minute current from the main capacitor 13 to flow therethrough and through the commutating capacitor 56, resistor 61, condenser 63 and resistor 65 to the negative bus, the resistor 65 produces a voltage which triggers the main SCR 54. Since the main SCR 54 is rendered conducting, the circuit comprising the main capacitor 13, inductance 11 and discharge tube 17 is closed. The charge stored on the main capacitor 13 is then caused to be suddenly drawn through the flash tube 17 with production of flash light with which the object being photographed is illuminated.

As has been mentioned above, when a current is caused to flow through the above-described impedance circuit by the discharging of the auxiliary capacitor 47 resulted from the closure of the trigger switch 31, the Zener diode produces a Zener voltage thereacross which is applied to the light measuring circuit 49. Thus, it is at a point in time almost equal to the time of the initiation of a firing operation of the flash tube 17 that the light measuring circuit starts to operate. When the amount of light incident upon the light sensitive element 51 has reached a predetermined value, the light measuring circuit 49 produces a firing stop signal from the output terminal **49*b* thereof. Responsive to this, the SCR 58 is rendered to effect a discharging of the commutating capacitor 56 through the SCR 58, diode 70 and the auxiliary capacitor 47. Therefore, applied across the cathode and anode of the main SCR 54 is the part of a surge voltage which is unabsorbed by the auxiliary capacitor constituting part of a protection circuit, that is, a surge voltage almost equal to the voltage appearing across the commutating capacitor 56 at the time of the initiation of discharging thereof as a reverse bias voltage. Therefore, the main SCR 54 is turned to the non-conducting state where the discharge path of the main capacitor 13 through the inductance 11 and flash tube 17 is no longer effective to fire the flash tube 17**. Thus, the emission of light of flash is stopped.

As is understandable from the foregoing, according to the present invention, an impedance circuit is provided in the discharge path of a auxiliary capacitor so that the single auxiliary capacitor suffices to accomplish both functions of actuating the light measuring circuit and of assuring that a sufficient voltage exists across the flash tube at the time of triggering of the tube despite the fact that the voltage on the main capacitor is insufficient for firing the tube. Therefore it is made possible to provide a computer type electronic flash device of simple construction, which is compact and has low production cost.

Further, since a part of the surge voltage produced by the influence of the various capacitance components in the circuit when the commutating capacitor is discharged is absorbed by the auxiliary capacitor 47 through the diode 70, and the reverse bias voltage applied to the main SCR 54 is made almost equal to the voltage to which the commutating capacitor 56 is charged at the time of the initiation of discharging thereof, an SCR of low reverse breakdown voltage and of low price may be selected for employment as the main SCR 54.

What is claimed is:

1. An electronic flash device having a flash tube, a main capacitor, an auxiliary capacitor, means for applying the sum of a voltage across said main capacitor and a voltage across said auxiliary capacitor to said flash tube, a light measuring circuit for producing a signal corresponding to a quantity of incident light from an object being photographed, and a control circuit responsive to the output signal from said light measuring circuit for controlling the duration of firing of said flash tube, the improvement comprising:

impedance means provided in the discharge path of said auxiliary capacitor which is rendered effective in response to an actuation of a trigger switch for said flash tube and having an output connected to a driving voltage input terminal of said light measuring circuit.

2. The improvement according to claim 1, wherein said impedance means includes a constant voltage member for applying a constant voltage to the driving voltage input terminal of said light measuring circuit.

3. The improvement according to claim 2, wherein said constant voltage member is a Zener diode.

4. The improvement according to claim 1, wherein said control circuit includes:

(a) a main thyristor connected in series with a series circuit composed of the main capacitor and the flash tube; and (b) a commutating capacitor connected to the main thyristor for applying a reverse bias voltage to the main thyristor in response to the output signal from said light measuring circuit.

5. The improvement according to claim 4, further comprising:

second impedance means arranged to be connected in parallel with said main thyristor at the anode and cathode thereof through said auxiliary capacitor when said commutating capacitor is discharged.

6. The improvement according to claim 5, wherein said second impedance means consists of a one way conductive element.

7. The improvement according to claim 6, wherein said auxiliary capacitor is connected at one pole thereof to the anode of said main thyristor, and said one way conductive element is connected at one pole thereof to the cathode of said main thyristor and at the other pole thereof to the other pole of said auxiliary capacitor.

8. The improvement according to claim 6, wherein said one way conductive element is a diode.

* * * * *